US005970634A

United States Patent [19]

Dann et al.

[11] Patent Number: 5,970,634

[45] Date of Patent: Oct. 26, 1999

[54] SEMI-SUBMERSIBLE MACHINE FOR REMEDIATION OF CONSTRUCTED DRAINAGE AREAS

[76] Inventors: James A. Dann; Ruby G. Dann, both of 2492 Timberline Dr., Winter Park, Fla. 32792

[21] Appl. No.: 09/024,652

[22] Filed: Feb. 17, 1998

Related U.S. Application Data

[60] Provisional application No. 60/064,121, Nov. 3, 1997.

[51] Int. Cl.[6] ..... A01B 13/00

[52] U.S. Cl. ..... 37/301; 37/410; 37/406; 37/340; 56/10.7

[58] Field of Search ..... 37/301, 304, 307, 37/340, 341, 342, 405, 406, 410, 403; 56/16.9, 13.7, 10.7

[56] References Cited

U.S. PATENT DOCUMENTS

| | | | |
|---|---|---|---|
| 2,858,626 | 11/1958 | Toulmin, Jr. | 37/410 |
| 2,863,273 | 12/1958 | Turner | 56/10.7 |
| 3,587,214 | 6/1971 | Willett | 56/10.7 |
| 4,310,975 | 1/1982 | Bibaut | 37/341 |
| 4,689,903 | 9/1987 | Gilbert . | |
| 4,907,356 | 3/1990 | Labounty | 37/406 |
| 5,305,585 | 4/1994 | Cousineau . | |
| 5,311,682 | 5/1994 | Sturdivant . | |
| 5,421,105 | 6/1995 | Schulte . | |
| 5,435,083 | 7/1995 | Thompson | 37/341 |

OTHER PUBLICATIONS

Eric Seagren, "Surgical Dredging Controls Turbility", Ellicott Machine Corp. website, www.dredge@dredge.com.

Ellicott Machinery Corp. "Series 370 Cutterhead" Ellicott website www.dredge@dredge.com.

Daily Record (Morristown NJ) "Mudcat™ Case Studies, Weed Harvesting" Newspaper article reproduced on Ellicott website www.dredge@dredge.com.

Alamo Group, Inc. "Specifications—Alamo McConnel Swingtrim" advertising piece Seguin Texas.

*Primary Examiner*—Victor Batson

*Attorney, Agent, or Firm*—Elsie C. Turner

[57] ABSTRACT

A semi-submersible machine moves on rotatable endless belt tracks over diverse surfaces and has two tools on articulated booms for remediation of roadside drainage ditches, retention ponds and other shallow water bodies. One tool is a cutter bar for cutting vegetation at a plurality of angles and positions above or under water, and the other tool is a rotatable pair of opposing clawlike jaws for raking or scouring soil above or under water to restore percolation performance, and to remove loosened vegetative matter without removing soil and water. The vehicle is submersible to a depth of forty inches, and can traverse a slope of thirty degrees while its tilting control platform remains above water and level, thereby maintaining stability of the vehicle.

9 Claims, 8 Drawing Sheets

SEMI-SUBMERSIBLE MACHINE FOR REMEDIATION OF CONSTRUCTED DRAINAGE AREAS

BACKGROUND OF THE INVENTION

This is a formal application claiming the benefit of a provisional application, Ser. No. 60/064,121, filed Nov. 3, 1997.

This invention concerns a device for maintaining percolation performance of retention ponds or ditches that are created to collect run-off and return it to the aquifer through sand and gravel filtration beds. These water bodies tend to be seeded by weeds, grasses, water lilies and the like. The vegetation produces roots and decaying foliage that interfere with the percolation process.

Current methods of removing the intruding growth include mowing it with conventional mowers when it is not under water, or treating it with a defoliant, both of which compound the problem by leaving the dead or cut vegetation on the bottom of the retention area to impede the percolation process. The retention areas remain fill, and new run-off containing pollutants spills out of the retention area to adjacent land and water resources.

Various earth digging machines and dredges have been in use to remove material from the bottom of ponds and navigation channels. A number of excavating devices utilize mechanical clamshells, draglines or suction pumps to dig into the soil and remove it. This type of operation causes great disturbance to the bottom of the waterway, churning and removing bottom soil and water. Use of such devices in run-off retention areas would inappropriately remove the material deposited as a filtration bed. Other machines utilize a cutting device to loosen material from the bottom, and a pump to remove the dredged material in the form of a slurry that is deposited in a constructed lagoon or settling basin. This too would inappropriately remove the filtration material. Generally the machines are either very heavy land vehicles—bulldozers, backhoes, or other excavators which operate on dry land and cannot go to the center of a pond—or large floating dredges, (such as the costly Ellicott International "Mud Cat" augur dredge that needs wire nets installed across each pond to winch it on its course), that need sufficient equipment to launch and sufficient depth in which to operate, making these devices unsuitable for many retention areas. Heavy earth moving machinery operating on the banks of ponds tends to cause considerable disturbance of the banks, requiring costly regrading and reseeding. An example is the "menzi muck" made in Switzerland. It is a wheeled tractor with a shovel on an articulated boom mounted in the front of the vehicle. Its wheels are individually extensible both horizontally and vertically, making the vehicle capable of straddling a ditch and removing debris therefrom. This device is of limited use because the vehicle itself is not intended to be partially submerged in water, as it has insufficient traction for this purpose, the wheels make deep ruts in soft ground, and it frequently gets stuck in muddy areas.

There is no machine on the market at the present time which has the ability to traverse sloping banks and diverse surfaces, and enter the water in these run-off retention areas with minimum disturbance to the subsurface, to rake but not remove the soil, and remove the vegetative debris that clogs the percolation surfaces.

Accordingly there is a need for a versatile semi-submersible machine, capable of traversing sloping banks and diverse surfaces without leaving deep ruts, that can cut underwater vegetation, scour and loosen the bottom of a clogged retention pond, and remove dead and dying vegetative matter without unnecessarily digging up and removing the filtration medium or the water to be percolated. Preferably the vehicle should travel on rotating endless belt tracks to distribute the weight load, as opposed to using wheels that would sink into the retention pond filtration medium and disrupt the layered sand and gravel. There is also the need that such device would require only one operator, and that it could move under its own motive power from a drainage ditch to its associated retention pond.

SUMMARY OF THE INVENTION

The semi-submersible machine of the present invention moves on rotatable tracks on diverse surfaces and has two tools for remediation of roadside drainage ditches, retention ponds and other shallow bodies of water. One is a cutter bar for cutting vegetation at a plurality of angles and positions above or under water, on the bottom or banks of a water body, or overhead, on either side of the vehicle, mounted at the end of an articulated boom. The other tool is a rotatable pair of opposing clawlike jaws, also mounted on an articulated boom, the combination having eight robotic degrees of freedom, the clawlike jaws capable of raking or scouring pond bottoms and banks to restore percolation performance, and of closing around and removing loosened vegetative matter without removing soil and water with it. The vehicle is submersible to a depth of forty inches and can traverse a slope of thirty degrees while its tilting control platform remains above water and level, preventing the weight on the platform from acting as a capsizing force.

DETAILED DESCRIPTION OF THE DRAWINGS

Figure 1:
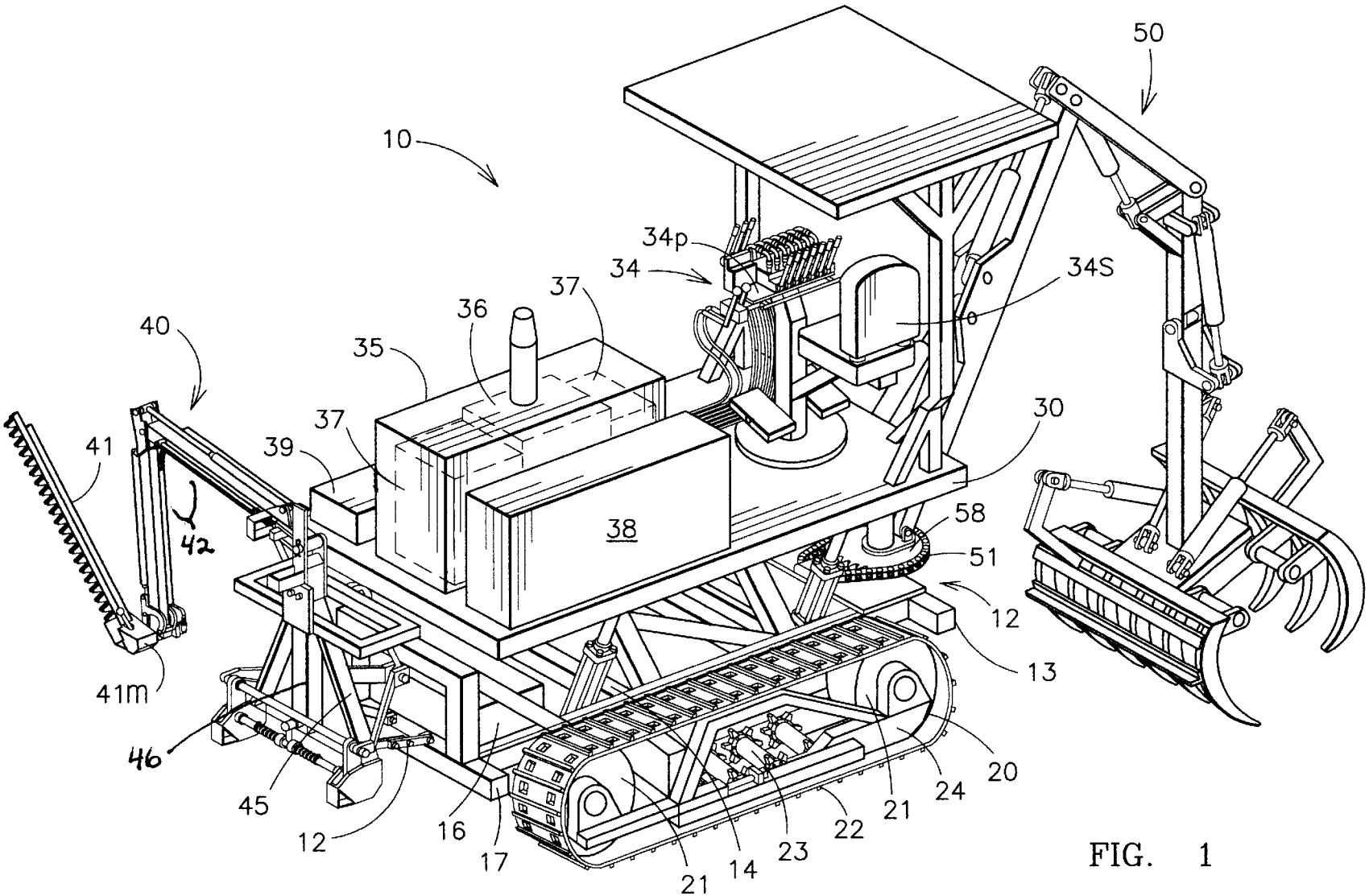
FIG. 1 is a perspective view of the invention.
Figure 2:
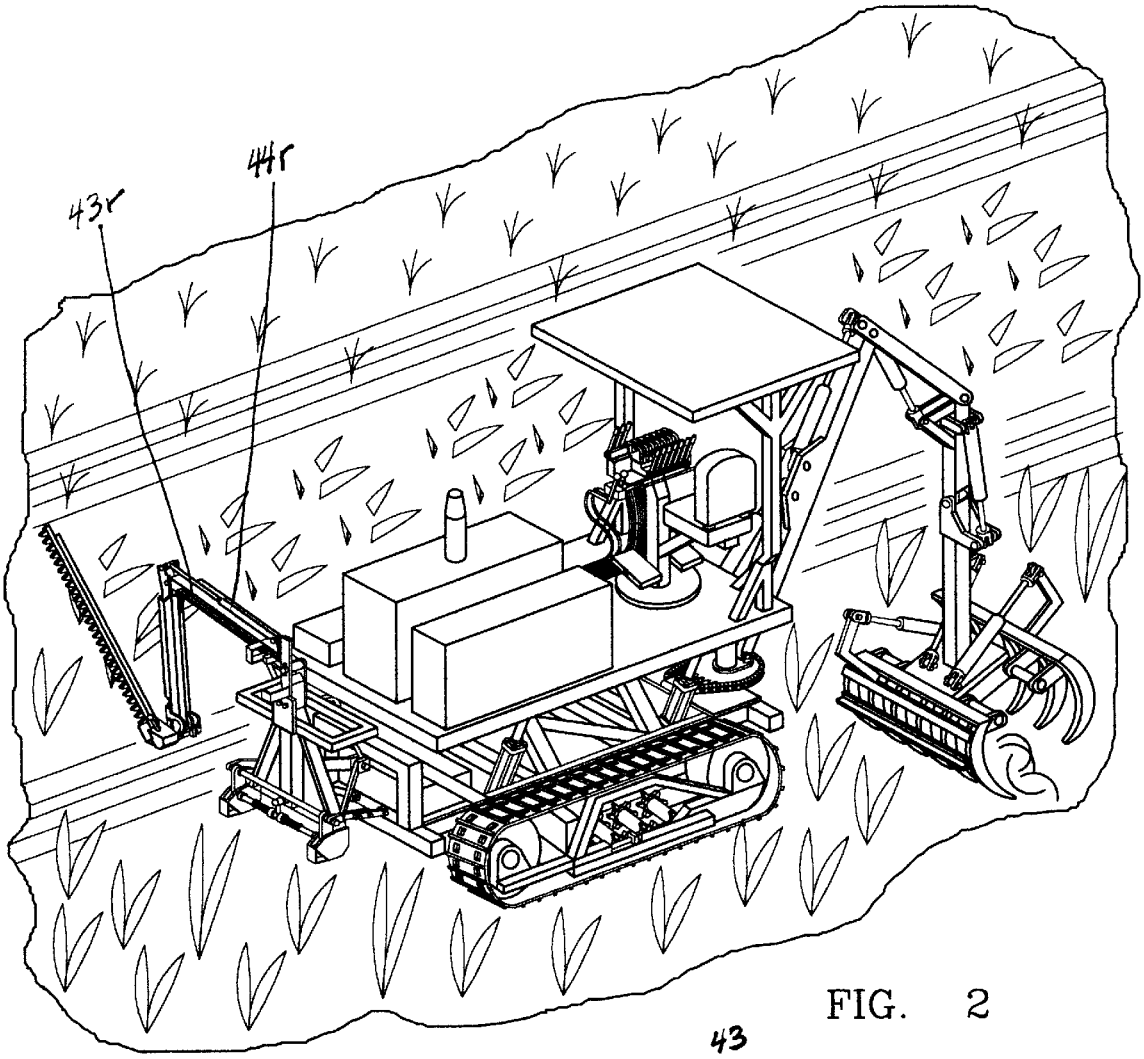
FIG. 2 is a perspective view of the invention in a shallow pond or drainage basin.
Figure 3:
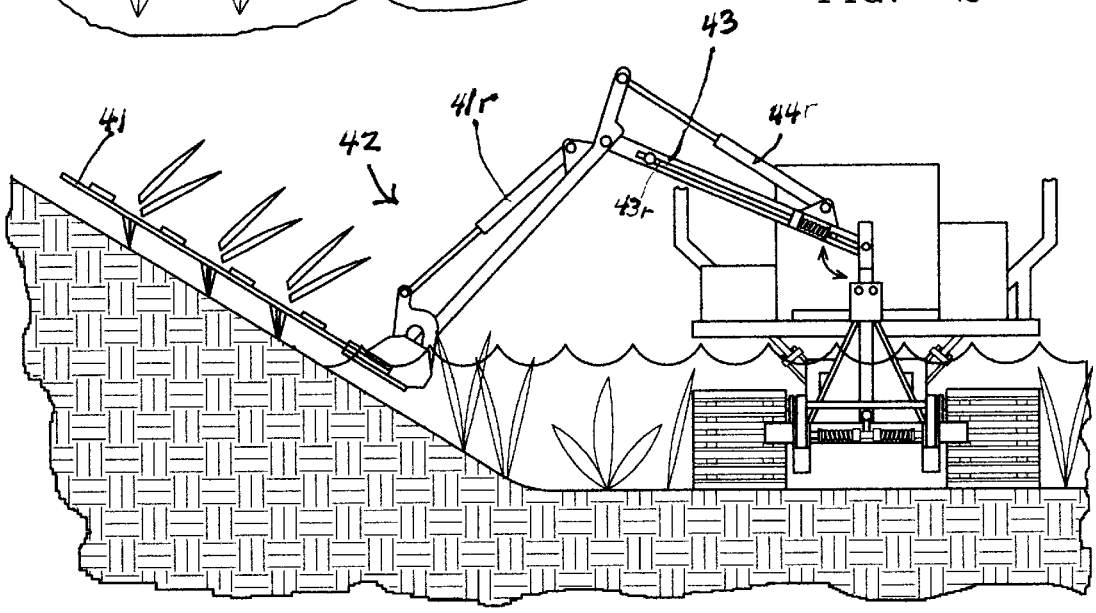
FIG. 3 is a frontal elevation of FIG. 2, depicting the invention cutting grasses on the edge of the pond.
Figure 6:
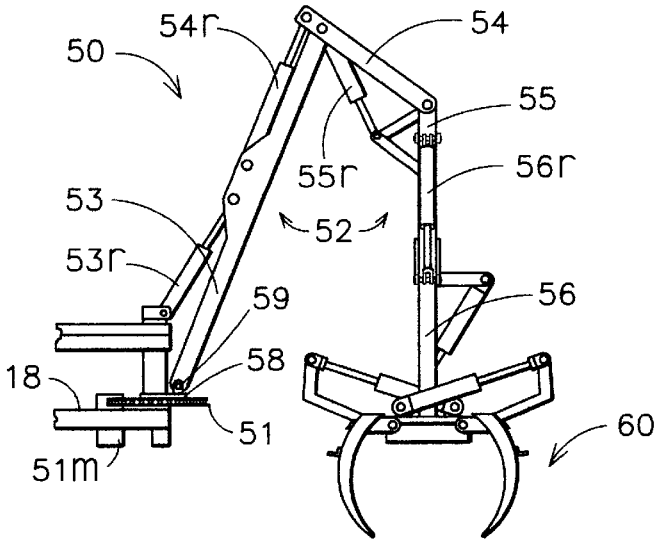
FIG. 6 is a detail side elevation of the opposing claws element of the invention, with both claws in an open position.
Figure 7:
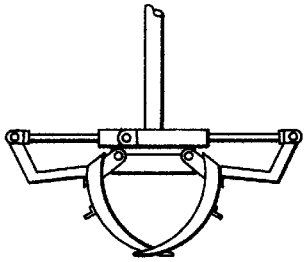
FIG. 7 is a detail side view of the claws in a closed position.

As illustrated in FIGS. 1-through 5 and 20 through 23, the machine 10 is essentially a semi-submersible vehicle moving on rotatable tracks for traveling on a variety of surfaces and terrain, and equipped with two types of implements, one, a sickle cutter and boom assembly 40, for cutting vegetation above or under water, and the other, a claw and boom assembly 50, adapted for soil penetration. The invention has a rectangular main framework 11 having a front cross beam member 12, a rear cross beam member 13, intermediate crossbeams 14 and 15, and side beams 16. At the forward end of main framework 11 rests a counterweight 17 contributing to stability of the invention 10, in view of the weight of the claw assembly 50 attached to the rear of the main framework 11.

Attached to the side beams 16 are track assemblies 20 supported on front and rear sprocketed rollers 21 supporting and engaging endless belt tracks 22. Additional small sprocketed guide rollers 23 are disposed intermediate the front and rear rollers 21. All the rollers are mounted on a pair of track frame members 24 attached to the side beams 16 of the main framework 11 shown in FIG. 23. Propulsion of the tracks is accomplished with a pair of hydraulic motors 25 coupled directly to drive shafts 21-*d* of each of the rear rollers 21 with splined couplings 21-*c*. All parts of the main framework 11 and track assemblies 20 should be made of materials that can survive frequent and prolonged immersions in contaminated run-off water. For instance, the bearings 27 for the various roller assemblies 23 are ideally made of nylon. Tracks 22 can be conventional rubber snowmobile tracks.

Figure 4:
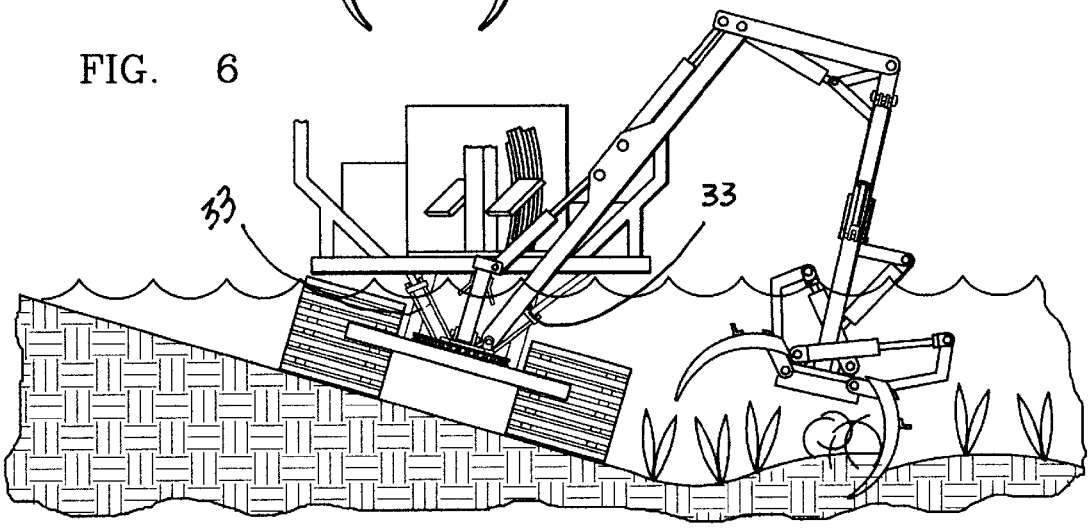
FIG. 4 is a rear elevation of the invention depicting the tilting property of the operator platform, and raking of basin bottom.
Figure 5:
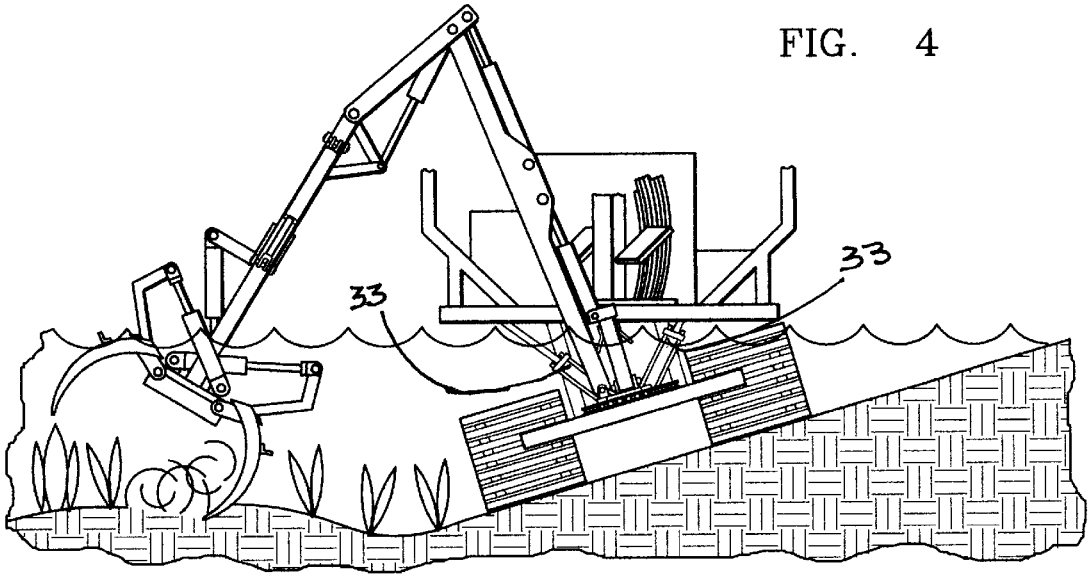
FIG. 5 is similar to FIG. 4 depicting tilting of the platform on the opposite side of the invention.
Figure 8:
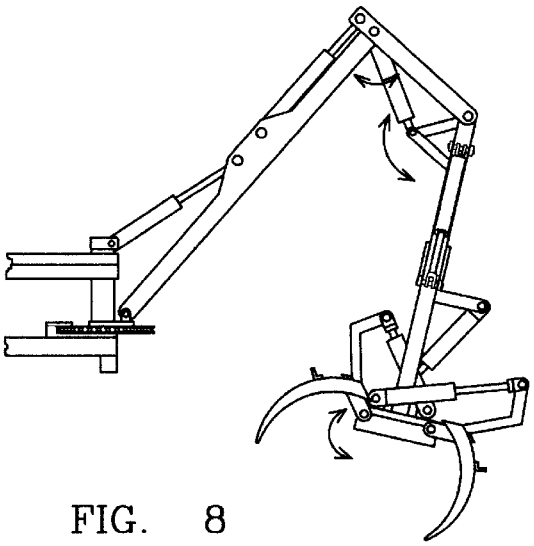
FIG. 8 is similar to FIG. 6, showing independent movement of the opposing claws.
Figure 9:
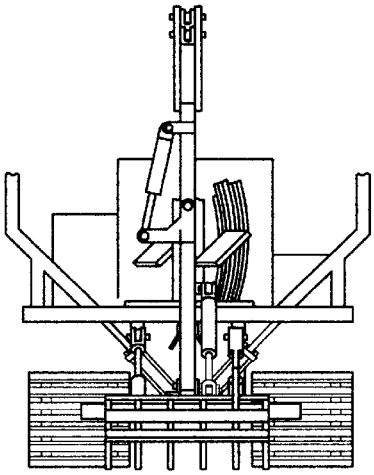
FIG. 9 is a rear elevation of the invention with the claws and supporting boom means aligned with the fore and aft axis of the invention.

Referring to FIGS. 1, 4, and 5, a control platform 30 is tiltably supported on A-frames 31 affixed to and straddling mainframe 11. Platform 30 tilts from side to side, pivoting on rod 32 centered fore and aft over A-frames 31 and mainframe 11. Tilting of the platform 30 is accomplished by means of hydraulic jacks 33 connected to each side of the platform, and attached at their lower ends to side beams 16 as shown in FIGS. 4 and 5. The maximum angle of tilt relative to the main framework is approximately 30°. When the vehicle is traversing a slope, maintaining the platform in the horizontal plane helps to stabilize the vehicle by keeping the center of gravity of the objects on the platform centered over the vehicle rather than at an angle that would result in a capsize.

Figure 23:
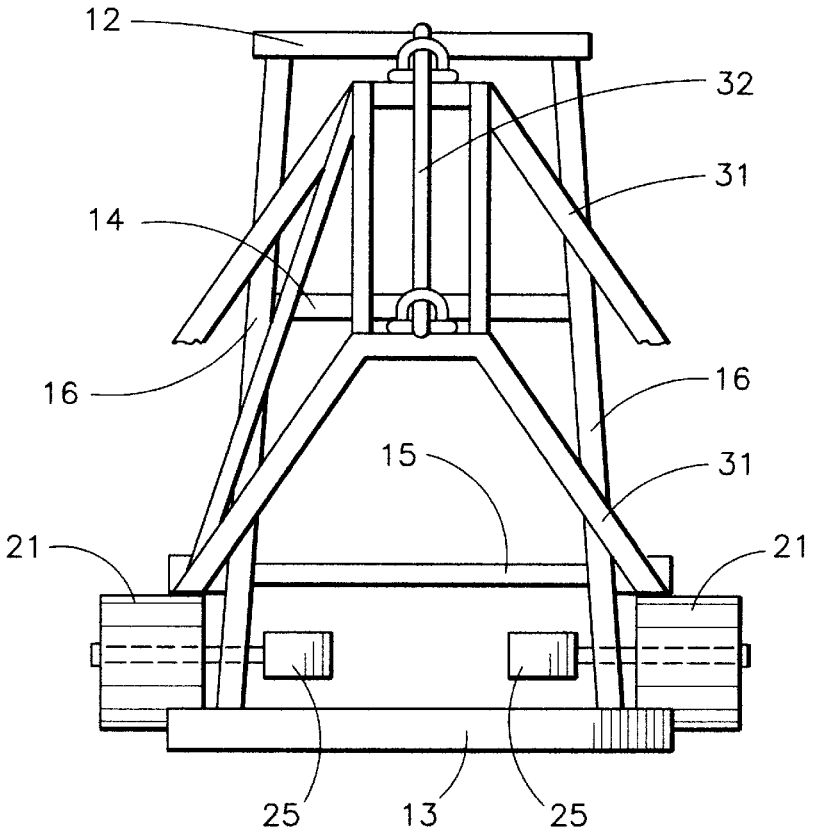
FIG. 23 is a rear perspective view of parts of the framework of the invention.
Figure 24:
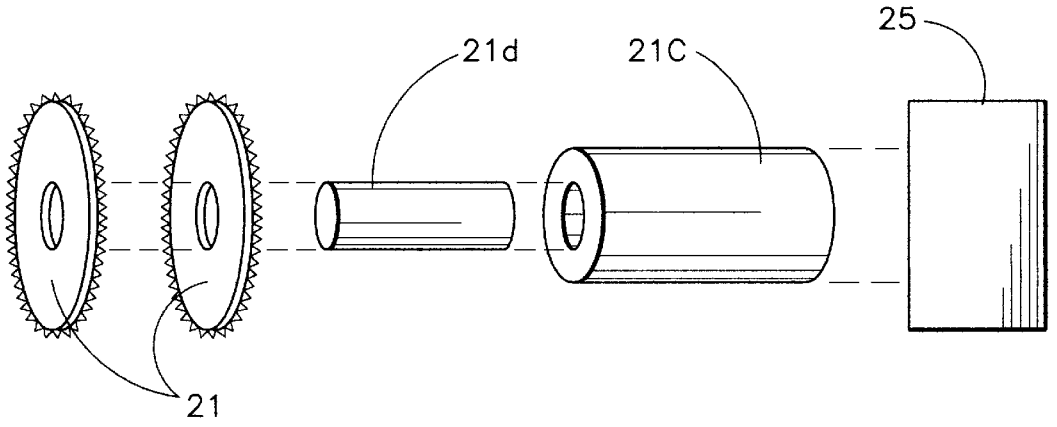
FIG. 24 is a detail exploded view of a rear roller, drive shaft, coupling and motor.

FIG. 23 shows more particularly the relationship of A-frames 31 to main framework 11, and rod 32, as well as rear sprocket rollers 21 and hydraulic motors 25. FIG. 24 is a detail exploded view of a rear roller 21, shaft and coupling to hydraulic drive motors 25.

Atop platform 30 is the rotatable operator console 34, with seat 34-*s* and hydraulic control panel 34-*p*. Rotation of the console 34 is by hydraulic means. The source of power for the vehicle is positioned under housing 35 containing a conventional combustion engine 36, preferably diesel, and pairs of hydraulic pumps 37 converting the power of the engine 36 to hydraulic power, which is in turn delivered to the various working parts of the machine 10 through hoses, not shown, and controlled at the console control panel 34-*p*. Also resting on platform 30 are a hydraulic oil tank 38 and an engine fuel tank 39.

Referring to FIGS. 3 and 16 through 19, a hydraulically powered cutter assembly 40 comprising sickle cutter bar 41 is pivotably mounted on outboard end of articulated boom member 42. Cutting action is powered by hydraulic motor 41-*m* at the inboard end of cutter bar 41. Articulated boom member 42 is comprised of main boom arm 43 and dipper arm 44 that are pivotably connected to each other. Main boom arm 43 is pivotably mounted on support post 46 in an A-frame support structure 45 attached to the forward crossbeam 12 of main framework 11. Pivoting movements of each boom section and the cutter bar are controlled by conventional hydraulic piston/cylinder ("ram") members 41-*r*, 43-*r*, and 44-*r*. Main boom arm 43 pivots through approx. 270° in a vertical plane perpendicular to longitudinal axis of the vehicle, thereby permitting entire cutter assembly 40 to swing overhead from one side of the vehicle to the other. The dipper arm 44 pivots through approximately 270° in the same vertical plane. Each hydraulic ram is controlled separately. The entire cutter assembly 40 shown is the Alamo-McConnel Swingtrim manufactured by Alamo Group, Inc. of Seguin, Tex.

In robotic terms, the articulations of the sickle cutter and boom assembly give it four degrees of freedom. It can mow or trim vegetation overhead or on the ground, angularly along on banks, above and below water, in front and to either side of the vehicle.

Figure 10:
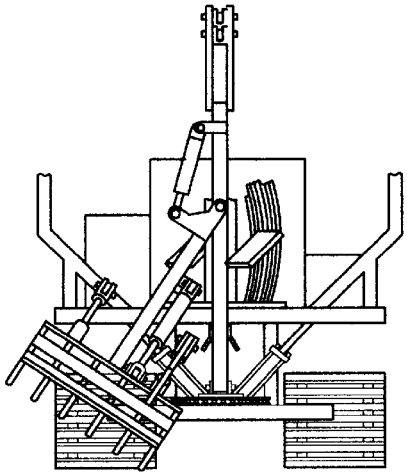
FIGS. 10 and 11 are similar to FIG. 9, showing the side-to-side pivoting capability of the outboard boom member attached to the claws.
Figure 11:
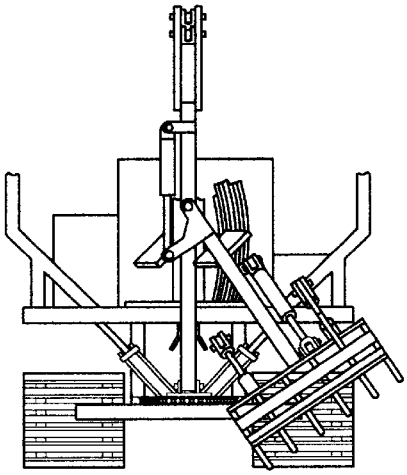
Figure 12:
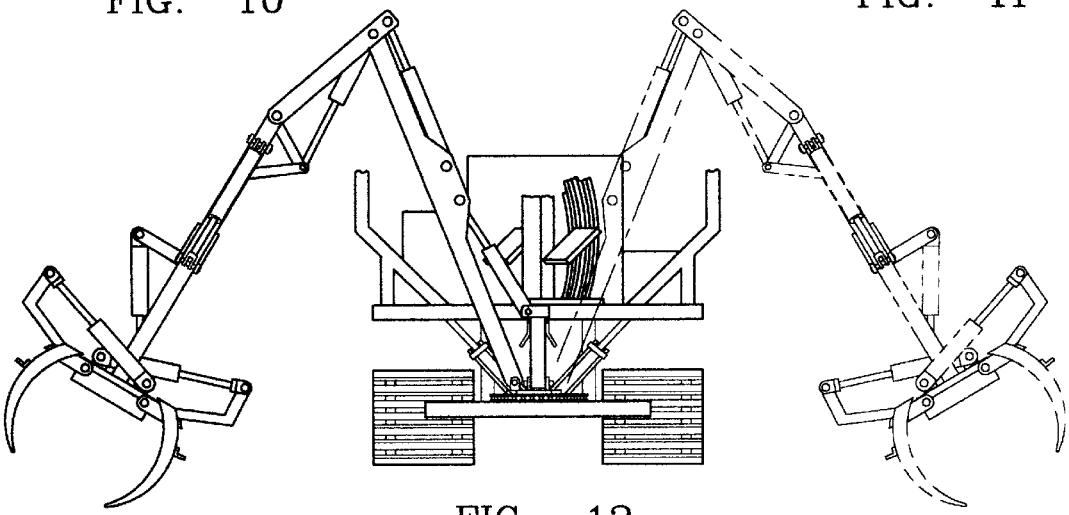
FIG. 12 is a rear elevation showing rotation capability of the inboard boom member through 180° from one side of the invention to the other.
Figure 13:
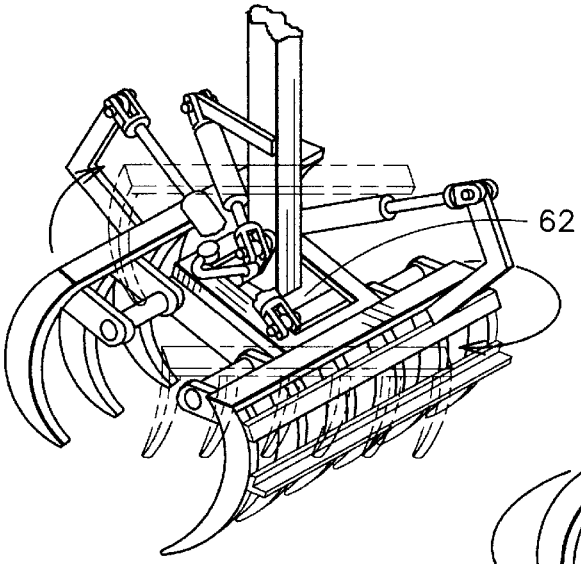
FIG. 13 is a detail perspective view of the claws showing rotation of the outboard boom and claws in phantom.
Figure 14:
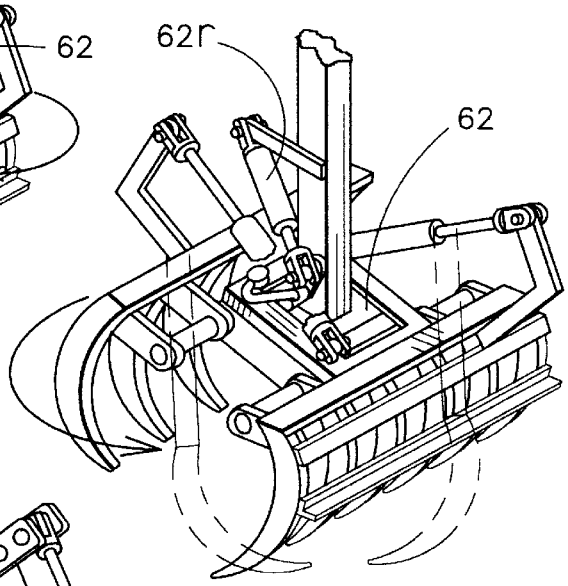
FIG. 14 is similar to FIG. 13, the phantom view showing the claws tilted and rotated to another position.
Figure 15:
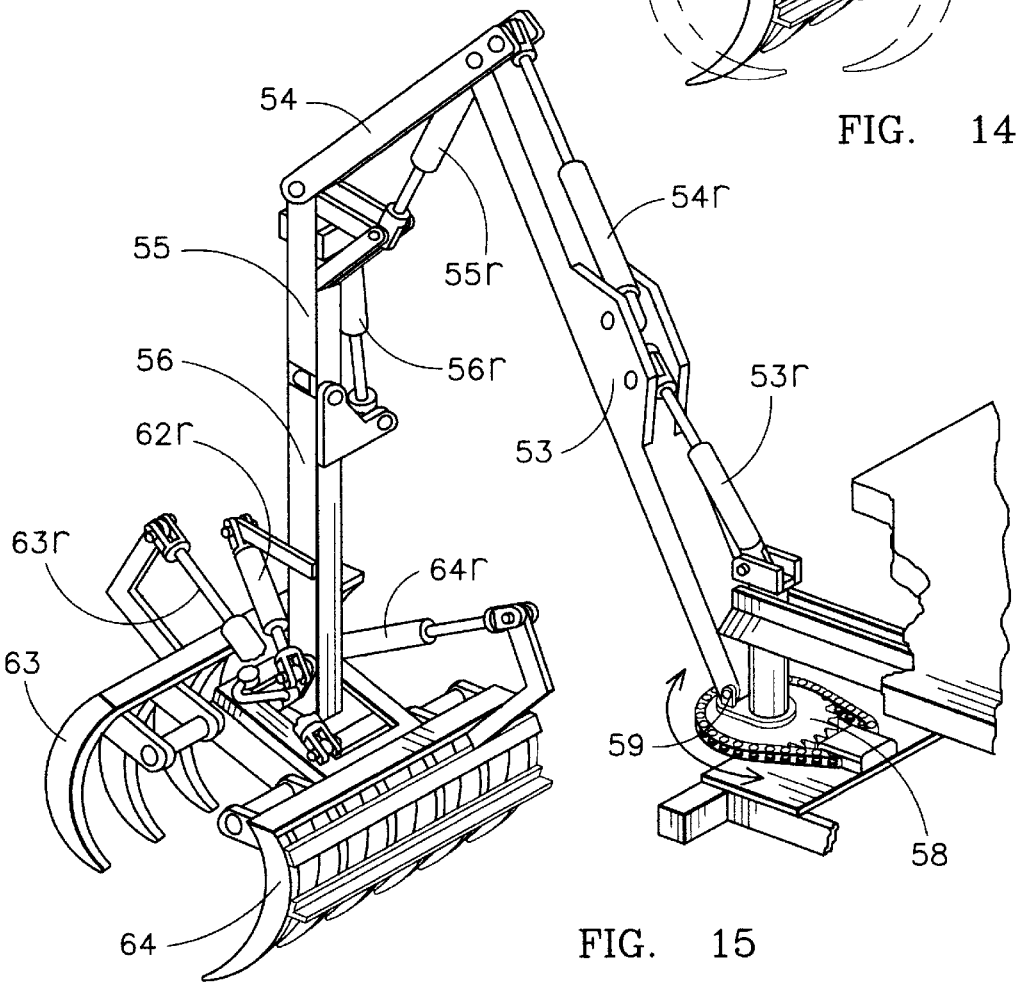
FIG. 15 is a detail perspective view of the claws attached to their boom assembly rotatable on a gear wheel at the attachment point to the main framework of the invention.
Figure 16:
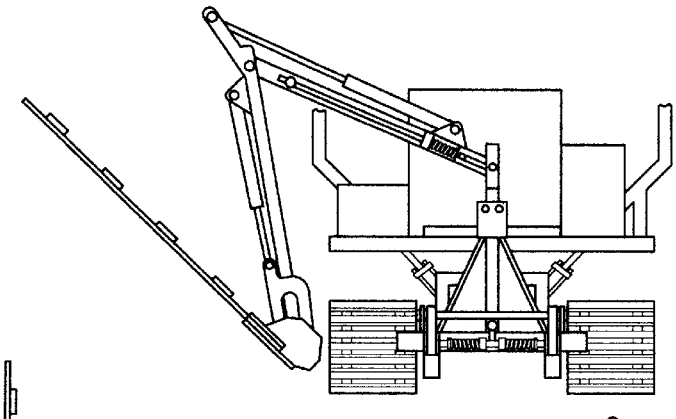
FIGS. 16 through 19 show a front elevation of the invention with various possible positions of the cutter sickle bar of the invention.
Figure 17:
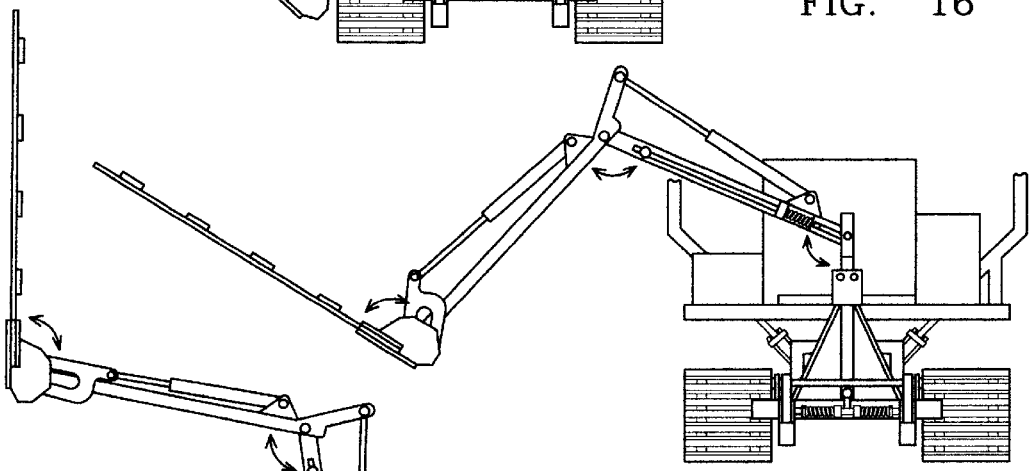
Figure 18:
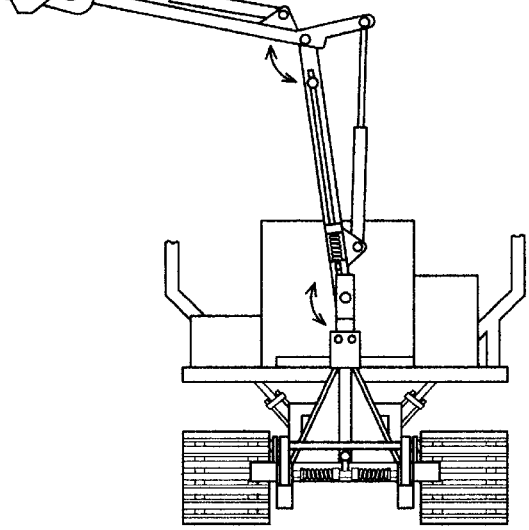
Figure 19:
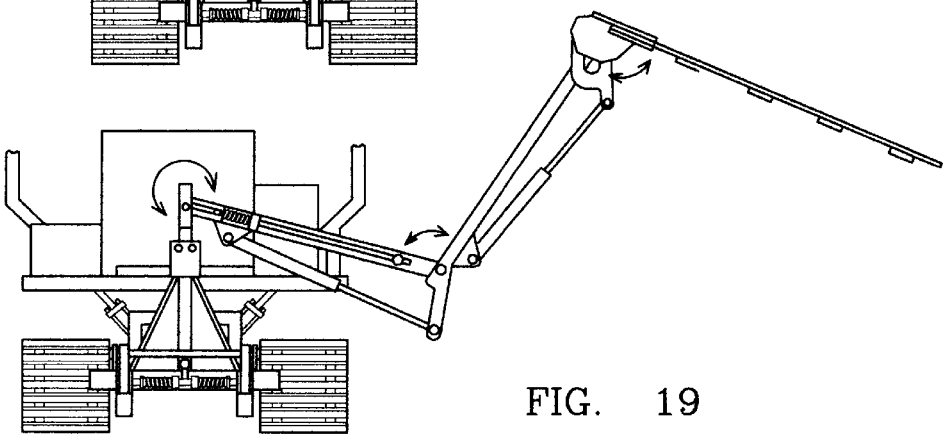
Figure 20:
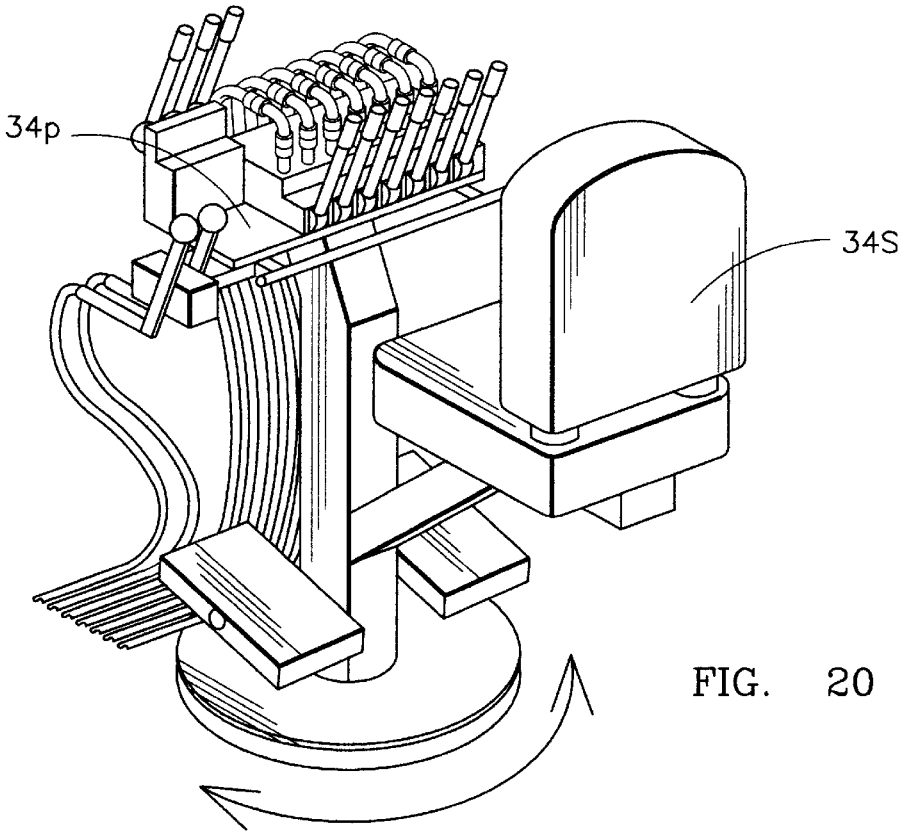
FIG. 20 is a perspective detail view of the swiveling operator seat and control console.
Figure 21:
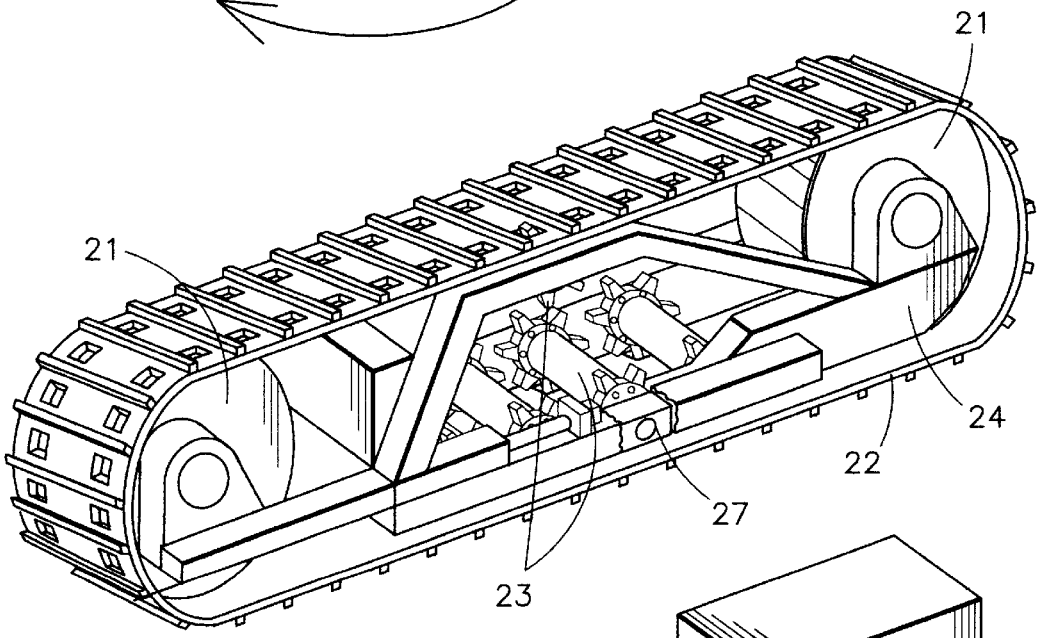
FIG. 21 is a detail perspective view of a track assembly with a cutaway revealing a bearing for the shaft of a small sprocket roller.
Figure 22:
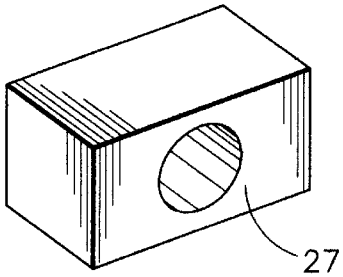
FIG. 22 is a detail view of one of the bearings for the smaller sprocket rollers.

Referring to FIGS. 6 through 15, an hydraulically powered claw and boom assembly 50 is rotatably mounted on a supporting plate 18 attached to rear crossbeam 13 of main framework 11. The means of rotation is a sprocketed rotating gearwheel and chain assembly 51 mounted in a horizontal plane, driven hydraulically by motor 51-*m*, which allows the entire assembly 50 to swing from one side of invention 10 to the other through an angle of a little more than 180°. Articulated boom member 52 is comprised of a main inboard arm 53 pivotably attached to gearwheel 58 at bearing 59. Hydraulic ram 53-*r* powers arm 53 through an angle of approximately 100°. Pivotably connected to outboard end of main arm 53 is first intermediate boom arm 54. It pivots through approx. 120° in vertical plane, powered by hydraulic ram 54-*r*. Second intermediate boom arm 55 is pivotably attached to the outboard end of first intermediate boom arm 54 and pivots through approximately 50° inward and outward relative to the base of main boom arm 54. It is powered by hydraulic ram 55-*r*. Distal boom arm 56 is pivotably attached to the outboard end of second intermediate boom arm 55 and swings from side to side, as shown in FIGS. 10 and 11, through approximately 45°, powered by hydraulic ram 56-*r*. Claw assembly 60 is rotatably mounted at the outboard end of distal boom arm 56. Opposing claws are each mounted pivotably to base member 62. Base member 62 rotates on a shaft inside distal boom arm 56, thereby rotating the entire claw assembly, as indicated in phantom and by arrows in FIGS. 13 and 14. This rotation is accomplished by means of hydraulic ram 62-*r*. Claws 63 and 64 are pivotably attached to base member 62 to open and close independently with respect to each other, which movements are controlled by hydraulic rams 63-*r* and 64-*r* respectively.

The articulations of claw and boom assembly 50 give it eight robotic degrees of freedom. Claw 63 can be used as a rake to scour the bottom of a retention pond or drainage ditch. Together the claws may be use to dig and remove a clogging bottom layer preventing the underlying soil to absorb the retained water. They may also be used to grasp and remove debris to be deposited in a dumpster or truck. Use of the machine is not limited to constructed drainage areas; for instance, natural lakeshores and shallow ponds to a depth of forty inches may be treated with this machine.

The foregoing description of the preferred embodiment of the invention has been presented to illustrate its principles and not to limit it to the particular embodiment illustrated or the uses described. It is intended that the scope of the invention be defined by all of the embodiments encompassed within the claims and their equivalents.—a source of power for propulsion of the device and operating each of its movable components.

What is claimed is:

1. A semi-submersible machine for remediation of constructed drainage areas and shallow water bodies comprising:

multi-surface vehicle having rotatable tracks and capable of traversing inclines of up to thirty degrees of slope, said vehicle being submersible to a depth of forty inches and having opposing ends;

hydraulic power system and hydraulic control system;

first articulated boom member pivotably mounted at one said opposing end of said vehicle, said boom member having a free end;

first tool assembly pivotably attached to said free end of said first boom member, said first tool assembly comprising a sickle cutter bar;

second articulated boom member rotatably attached at another said end of said vehicle, said boom member having a free end;

second tool assembly rotatably attached to said free end of said second boom member, said second tool assembly comprising a pair of opposing claw-like jaw members, said second boom member and said second tool assembly in combination having at least five robotic degrees of freedom;

an operator platform having a control console, said platform tiltably mounted atop said vehicle at a height so that said platform remains above water when said vehicle is submerged, and tiltable so as to remain level while said vehicle is traversing said inclines.

2. A semi-submersible machine for remediation of constructed drainage areas and shallow water bodies, comprising:

multi-surface vehicle capable of traversing inclines, said vehicle being submersible up to a predetermined depth and having opposing ends;

first articulated boom member pivotably mounted at one said opposing end of said vehicle, said first boom member having a free end;

first tool assembly pivotably attached to said free end of said first boom member, said first tool assembly comprising a cutter member;

second articulated boom member rotatably attached at another said end of said vehicle, said second boom member having a free end;

second tool assembly rotatably attached to said free end of said second boom member, said second tool assembly comprising a pair of opposing claw-like jaw members;

an operator platform having a control console, said platform tiltably mounted atop said vehicle at a height predetermined so that said platform remains above water when said vehicle is submerged, and tiltable so as to remain level while said vehicle is traversing said inclines.

3. The device according to claim 2 wherein said cutter member is a sickle cutter bar.

4. The device according to claim 2 wherein said second boom member has a plurality of articulations, said opposing jaw members pivot between an open and a closed position independently of each other, and together said second boom member and said second tool assembly possess at least five degrees of robotic freedom.

5. The device according to claim 4 wherein said cutter member is a sickle cutter bar.

6. The device according to claim 5 wherein said vehicle is propelled on rotatable tracks.

7. The device according to claim 6 further comprising a hydraulic power system and hydraulic control system.

8. The device according to claim 5 wherein said vehicle is submersible to a depth of forty inches.

9. The device according to claim 5 wherein said vehicle is capable of traversing inclines of up to thirty degrees of slope.

* * * * *